US007690504B1

(12) United States Patent
Lail

(10) Patent No.: US 7,690,504 B1
(45) Date of Patent: Apr. 6, 2010

(54) BALL CARRIER AND METHOD OF USING SAME

(76) Inventor: Charles Aaron Lail, 450 3rd Avenue Dr. SE., Hickory, NC (US) 28602

( * ) Notice: Subject to any disclaimer, the term of this patent is extended or adjusted under 35 U.S.C. 154(b) by 0 days.

(21) Appl. No.: 12/362,012

(22) Filed: Jan. 29, 2009

(51) Int. Cl.
*A45F 5/00* (2006.01)

(52) U.S. Cl. ..... 206/315.9; 294/164; 294/165

(58) Field of Classification Search ..... 294/137, 294/164, 165, 166, 167; 206/315.1, 315.9, 206/315.91; 473/40, 41
See application file for complete search history.

(56) References Cited

U.S. PATENT DOCUMENTS

| | | | | |
|---|---|---|---|---|
| 1,187,243 | A | 1/1916 | Bernstein | |
| 1,506,505 | A | 8/1924 | Saxer | |
| 1,983,499 | A | 1/1934 | Rosenthal | |
| 2,531,092 | A * | 11/1950 | Waller | 206/435 |
| 2,604,355 | A * | 7/1952 | Schwarz | 294/87.26 |
| 2,655,402 | A * | 10/1953 | Johnson | 294/87.24 |
| 2,998,174 | A * | 8/1961 | Weder et al. | 294/164 |
| 3,830,418 | A * | 8/1974 | Newell | 294/164 |
| 4,103,773 | A | 8/1978 | Haber | |
| 4,214,684 | A | 7/1980 | Galowitz | |
| 4,591,051 | A | 5/1986 | Lowman | |
| 4,984,788 | A | 1/1991 | Harriman | |
| 4,993,548 | A | 2/1991 | Peterson | |
| 5,553,707 | A * | 9/1996 | Lion | 206/315.9 |
| 5,556,341 | A | 9/1996 | Bonn, Jr. | |
| 5,601,496 | A | 2/1997 | Beauchamp | |

* cited by examiner

*Primary Examiner*—Jacob K Ackun, Jr.
(74) *Attorney, Agent, or Firm*—Ashley Law Firm P.C.; Stephen S. Ashley, Jr.

(57) ABSTRACT

An apparatus for carrying a plurality of spherical objects such as billiard balls can include a rectangular frame defining an interior area for receiving the billiard balls, in which at least some of the balls contact an inner surface of the frame, and an engaging section connected to the frame and positioned within the interior area of the frame between two opposed sides of the frame. The engaging section can move between a release position in which the billiard balls can be placed into and removed from the frame, and an engage position in which the engaging section frictionally engages some of the balls, and the balls are maintained within the frame such that they are carried by the frame and can be transported therein.

20 Claims, 8 Drawing Sheets

Fig. 4
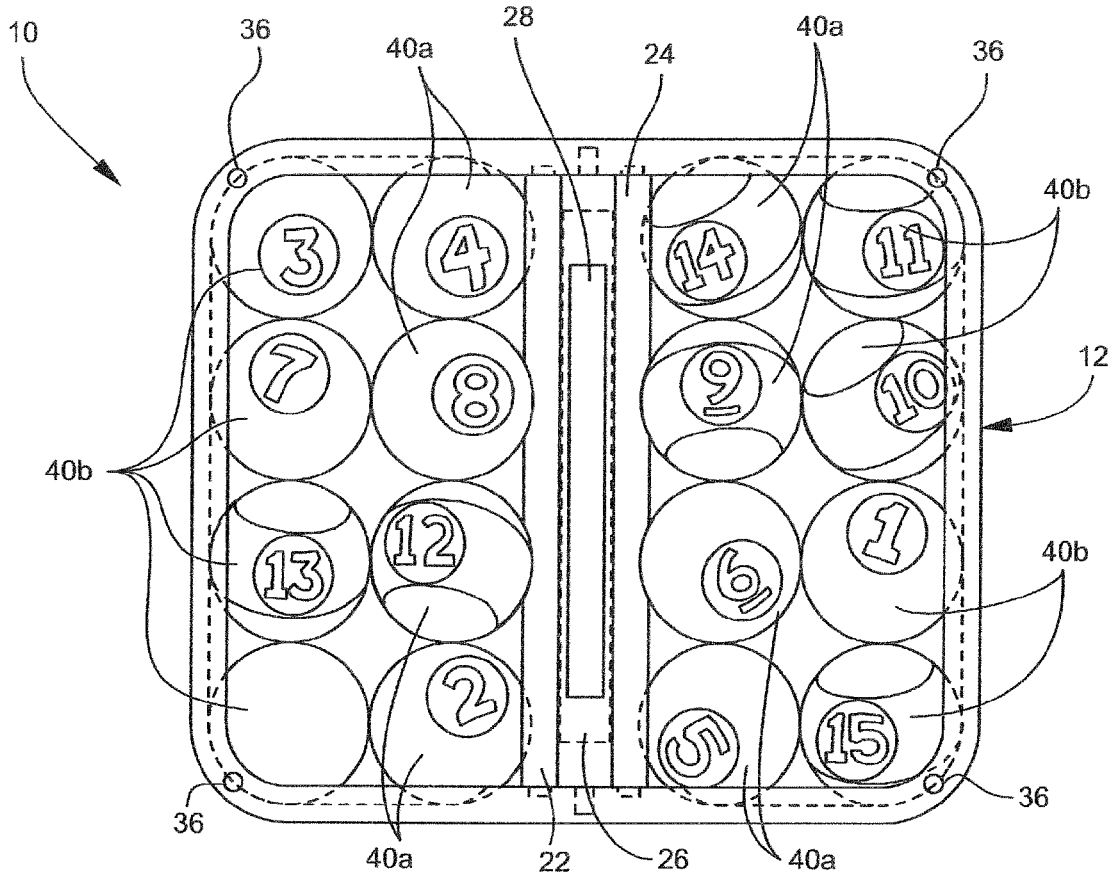
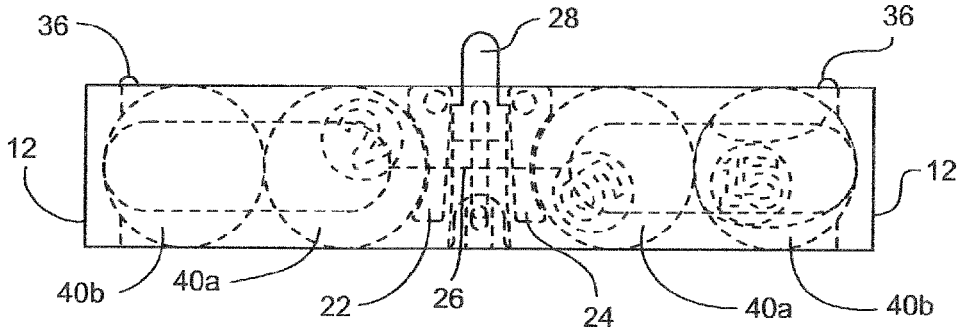
Fig. 5

BALL CARRIER AND METHOD OF USING SAME

TECHNICAL FIELD AND BACKGROUND OF THE INVENTION

The present invention relates to an article for holding and transporting spherical objects, such as balls. One embodiment of the invention provides a carrier that can be used to hold and transport billiard balls. In addition, this embodiment of the invention allows for quick and easy release of the balls on a billiard or pool table or other desired destination for the balls.

"Billiards" or "billiard games", as used throughout this application, refers generally to any of the many games played on an oblong table that involves driving small balls against one another or into pockets with a cue, and includes, but is not limited to, games known as "pool" and/or "pool billiards." Likewise, the term "billiard balls" throughout this application refers generally to any and all balls with which such billiard games can be played, and the term "billiard table" in this application refers generally to any table on which such billiard games can be played.

Billiards has been and continues to be a popular recreational activity, and is played in a variety of venues, such as homes, restaurants, bars, country clubs, and, of course, places known as "pool halls." In addition, billiards is played competitively by professional players.

Trays have commonly been used to hold and carry billiard balls from one point to another, such as from a check-out desk to the billiard table. The trays generally have sixteen circular indentations for receiving the balls. Such trays generally require the user to carry the rack by positioning his or her hand underneath the rack and balancing the rack on the hand while walking to the destination. This can be somewhat cumbersome and difficult for the user, particularly when attempting to navigate through a crowded area, which pool halls and other pool playing venues often are. As such, the racks are prone to tipping over if the user loses balance or being knocked over by another, resulting in the balls uncontrollably spilling out onto the floor or onto a table. This can lead to property damage, as well as personal injury to individuals who are struck by the loose balls or step on them and fall. The risk of spilling and injury is exacerbated when the person carrying the rack has been consuming alcohol, which is not uncommon at pool halls and other pool playing venues. Accordingly, there is a need and desire for an apparatus with which one can securely hold and transport billiard balls and the like.

Once the trays reach the desired table, the user must grasp each ball individually to remove it from the tray and place it on the table. Accordingly, there is also a need for an apparatus with which a user can transport billiard balls, and quickly remove them from the apparatus onto the desired table.

SUMMARY OF OBJECTS AND EMBODIMENTS OF THE INVENTION

Therefore, one object of the present invention is to provide an apparatus for securely carrying a plurality of spherical objects. Another object of the present invention is to provide an apparatus with which one can store and transport billiard balls. Another object of the present invention is to provide an apparatus that allows for immediate and simultaneous removal of the balls from the apparatus onto a billiard table or the like.

These and other objects of the invention can be achieved in the various embodiments of the invention described below. In one embodiment of the invention, an apparatus carrying a plurality of spherical objects comprises a frame defining an interior area for receiving the plurality of spherical objects, in which at least some of the plurality of spherical objects contact an inner surface of the frame, and an engaging element is connected to the frame and positioned within the interior area of the frame. The apparatus includes adjusting means for moving the engaging element between a release position in which the spherical objects can be placed into and removed from the frame, and an engage position, in which the engaging element frictionally engages at least some of the plurality of spherical objects, and the spherical objects are maintained within the frame such that the spherical objects are carried by the frame and can be transported therein.

According to another embodiment of the invention, the engaging element comprises first and second elongate walls defining a space therebetween, and the adjusting means comprises a center panel positioned in the space defined by the first and second elongate walls and is adapted for sliding movement therein. The center panel has an upper edge and a base edge, and has a graduated thickness, in which the base edge of the panel is relatively thicker than the upper edge such that upward movement of the center panel urges the first and second walls outward to frictionally engage at least some of the plurality of spherical objects.

According to another embodiment of the invention, downward movement of the center panel allows the first and second walls to retract inward, thereby disengaging the first and second walls from the spherical objects.

According to another embodiment of the invention, the center panel includes an opening proximate the upper edge to provide a handle for grasping.

According to another embodiment of the invention, the adjusting means can be moved from the release position to the engage position by grasping the handle and pulling upward.

According to another embodiment of the invention, the frame is rectangular, the first and second walls extend between opposed sides of the frame, and the plurality of spherical objects comprises sixteen billiard balls.

According to another embodiment of the invention, the apparatus includes a handle for facilitating carrying of the apparatus.

According to another embodiment of the invention, the frame includes a top surface and a bottom surface, a plurality of upwardly extending knobs are formed on the top surface, and a plurality of recesses are formed on the bottom surface in substantial vertical alignment with the upwardly extending knobs.

According to another embodiment of the invention, the frame includes a top surface and a bottom surface, and a plurality of downwardly extending knobs are formed on the bottom surface, and a plurality of recesses are formed on the top surface in substantial vertical alignment with the downwardly extending knobs.

According to another embodiment of the invention, an apparatus for carrying a plurality of billiard balls comprises a rectangular frame defining an interior area for receiving the plurality of billiard balls, in which at least some of the plurality of billiard balls contact an inner surface of the frame, and an engaging section connected to the frame and positioned within the interior area of the frame between two opposed sides of the frame. The engaging section is adapted for moving between a release position in which the billiard balls can be placed into and removed from the frame, and an engage position in which the engaging section frictionally engages at least some of the plurality of billiard balls, and the plurality of balls are maintained within the frame such that the plurality of balls are carried by the frame and can be transported therein.

According to another embodiment of the invention, the engaging section comprises first and second outer panels defining a space therebetween, and a center panel positioned in the space between the first and second panels. The center panel is adapted for sliding movement between the first and second panels, and has an upper edge and a base edge. The center panel has a graduated thickness in which the base edge of the center panel is relatively thicker than the upper edge such that upward movement of the center panel urges the first and second outer panels outward to frictionally engage at least some of the plurality of billiard balls.

According to another embodiment of the invention, downward movement of the center panel allows the first and second outer panels to retract inward such that the first and second outer panels are disengaged from the plurality of billiard balls.

According to another embodiment of the invention, the center panel includes an opening proximate the upper edge to provide a handle for grasping.

According to another embodiment of the invention, the engaging section is moved from the release position to the engage position by grasping the handle and pulling upward.

According to another embodiment of the invention, the frame is substantially square and sized to carry sixteen billiard balls.

According to another embodiment of the invention, the engaging section is connected proximate mid-points of two opposed sides of the frame, and divides the interior area of the frame into first and second interior sections having substantially equal areas. The first interior section receives a first inner column of four billiard balls and a first outer column of four billiard balls, and the second interior section receives a second inner column of four billiard balls and a second outer column of four billiard balls. The columns are positioned substantially parallel in relation to the engaging section.

According to another embodiment of the invention, when the apparatus is in the engage position, the first and second outer panels contact the first and second inner columns of billiard balls, respectively, and urges the first inner column of billiard balls against the first outer column of billiard balls and the second inner column of billiard balls against the second outer column of billiard balls. The first and second outer columns of billiard balls are urged against the inner surface of the frame, so that the balls are maintained by frictional engagement in the frame.

According to another embodiment of the invention, the first and second outer panels and the inner surface of the frame are shaped to conform to the curvature of the billiard balls, whereby the outer panels and the inner surface of the frame provide mechanical support to the balls.

According to another embodiment of the invention, a method of carrying billiard balls comprises the steps of providing a plurality of billiard balls, and providing a carrying apparatus that includes a rectangular frame defining an interior area for receiving the plurality of billiard balls, in which at least some of the plurality of billiard balls contact an inner surface of the frame, and an engaging section connected to the frame and positioned within the interior area of the frame between two opposed sides of the frame. The engaging section is adapted for moving between a release position in which the billiard balls can be placed into and removed from the frame, and an engage position in which the engaging section frictionally engages at least some of the plurality of billiard balls and the plurality of balls are maintained within frame. The balls are positioned in the interior area of the frame with the engaging section in the release position. The engaging section is moved to the engage position in which at least some of the plurality of billiard balls are engaged by the engaging section and the plurality of balls are maintained within the carrying apparatus.

According to another embodiment of the invention, the carrying apparatus is transported with the plurality of billiard balls maintained therein while the engaging section is in the engage position, and the carrying apparatus is positioned on a desired surface. Once positioned on the desired surface, the engaging section is moved to the release position, in which the plurality of billiard balls are disengaged from the engaging section and are released onto the desired surface.

BRIEF DESCRIPTION OF THE DRAWINGS

Objects of the invention have been set forth above. Further objects and advantages of the present invention may become apparent as the description of the invention proceeds when taken in conjunction with the following drawings, in which:

FIG. 4 is a top plan view of the ball carrier of FIG. 1; and

FIGS. 5-10 are front cross sectional views of the ball carrier of FIG. 1, illustrating a preferred method of using the ball carrier;

DESCRIPTION OF THE PREFERRED EMBODIMENTS AND BEST MODE

Figure 1:
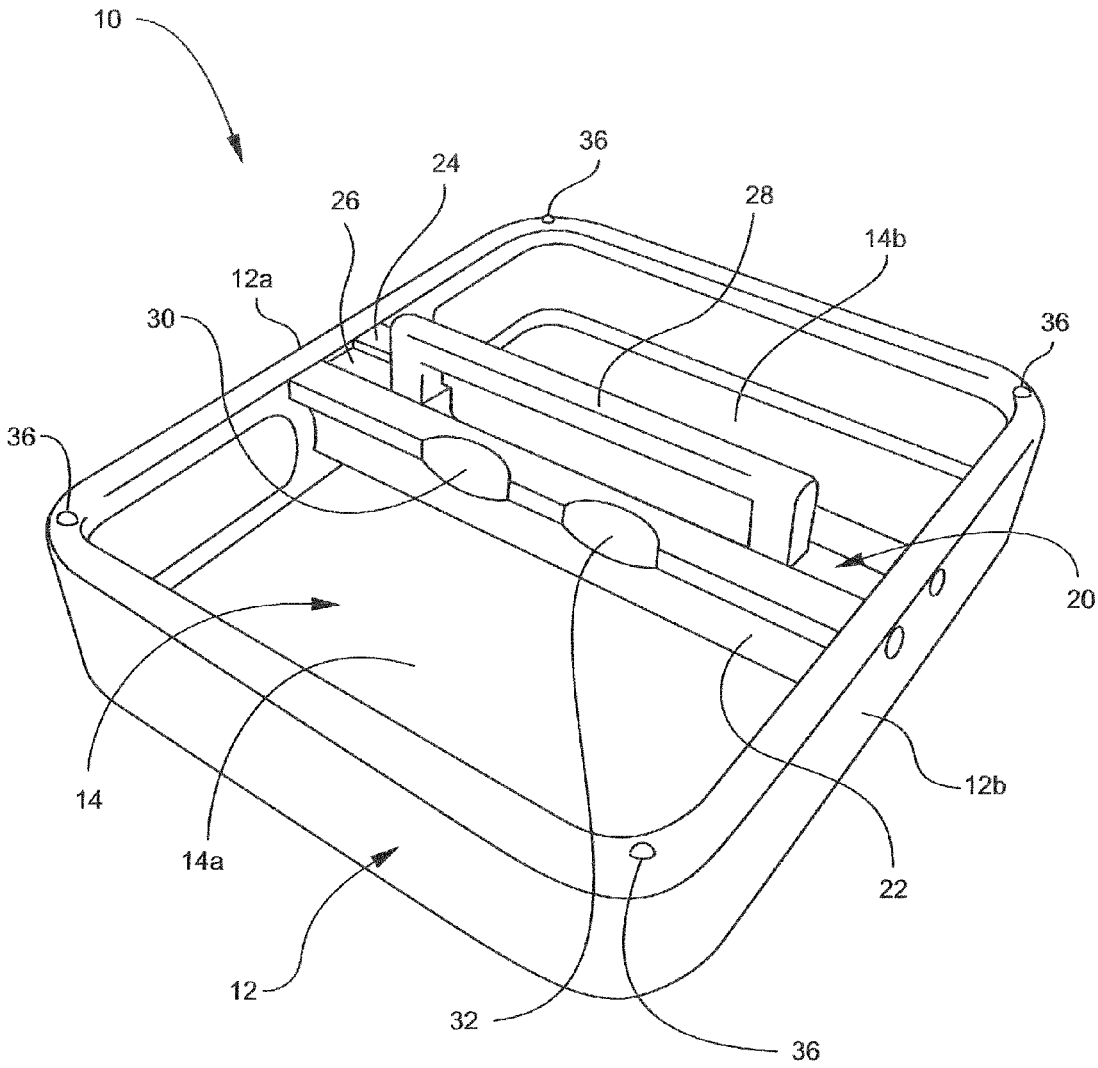
FIG. 1 is a perspective view of a ball carrier according to a preferred embodiment of the invention.

Referring now to the drawings, in which like numerals represent like components throughout, a ball carrier according to a preferred embodiment of the invention is illustrated in FIG. 1, and shown generally at reference numeral 10. The ball carrier 10 comprises a frame 12 defining an interior area 14, and an engaging section 20 positioned within the interior area 14 of the frame 12. The frame 12 is preferably rectangular, and in particular, is preferably square, although the frame 12 can be a variety of shapes. The carrier 10 is preferably made of molded plastic, but can be made of any suitable material, such as wood.

The engaging section 20 comprises two spaced apart outer panels 22, 24 attached to two opposed walls 12*a*, 12*b*, respectively, of the frame 12. Preferably, the outer panels 22, 24 are attached proximate mid-points of the opposed walls 12*a*, 12*b*, as shown in FIG. 1. As such, the outer panels 22, 24 divide the interior area 14 of the frame 12 into two substantially equal sections 14*a*, 14*b*.

A center panel 26 is positioned between the outer panels 22, 24, and can slide vertically in the space between the outer panels 22, 24. A handle 28 is formed on the top of the center panel 26, which aids the user in moving the center panel 26 up and down. The center panel 26 has a graduated thickness, in that the base 26*b* is slightly wider than the upper portion 26*a* of the center panel 26. Upward movement of the center panel 26 urges the outer panels 22, 24 slightly outward as the base

26*b* of the center panel pushes against the inner surfaces of the outer panels 22, 24. As such, upward movement of the center panel 26 moves the engaging section from a release position, in which the base 26*b* of the center panel is substantially co-planar with the bottom edge of the frame 12 and does not contact the inner surfaces of the outer panels 22, 24, to an engage position, in which the relatively wide base 26*b* of the center panel 26 contacts and exerts force against the inner surfaces of the outer panels 22, 24, thereby urging the outer panels 22, 24 outward.

In an alternative embodiment, the center panel 26 can have a uniform thickness, and the inner surface of each of the outer panels 22, 24 can be angled outward such that the outer panels 22, 24 are urged outward as the center panel 26 is moved upward.

Figure 2:
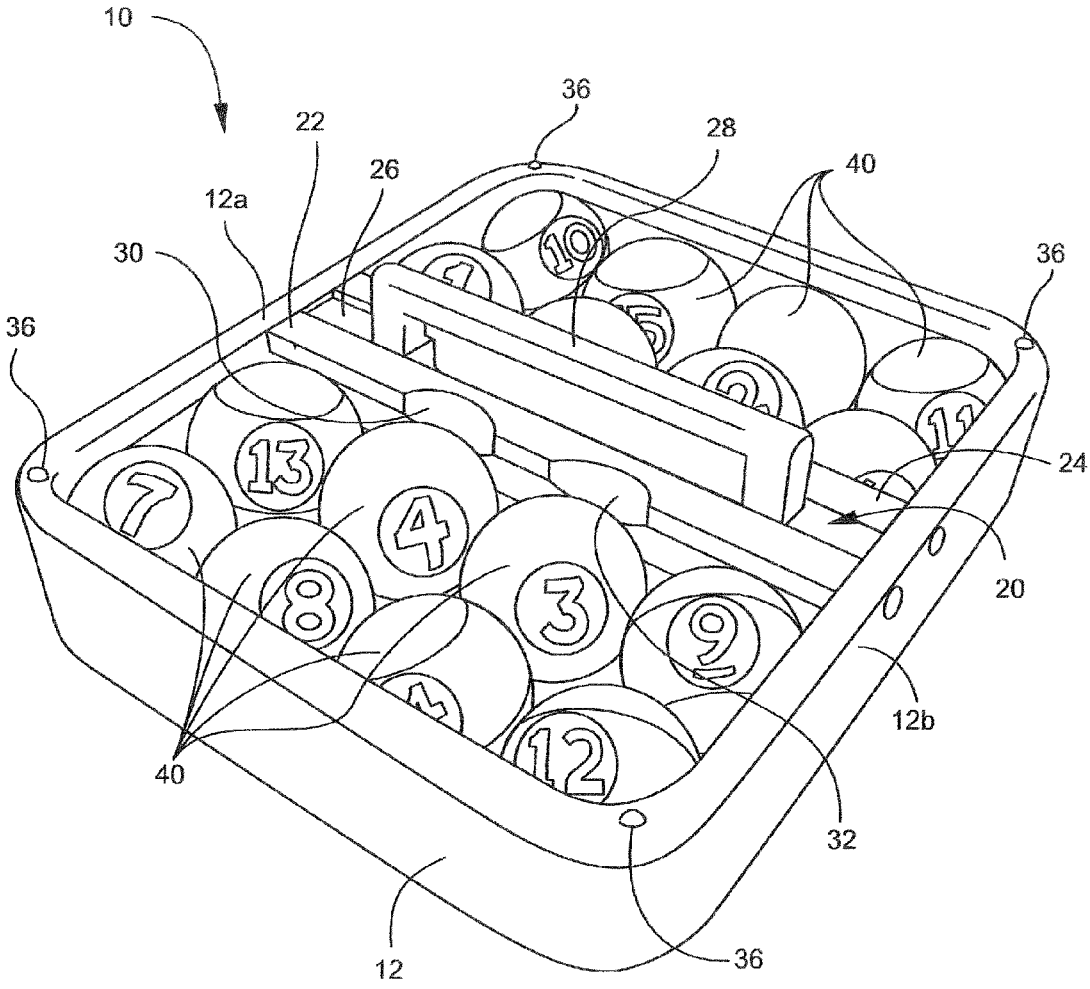
FIG. 2 is another perspective view of the ball carrier of FIG. 1, shown in use with billiard balls.

In a preferred method of using the carrier 10, the carrier 10 can hold and transport a plurality of billiard balls 40. As shown in FIG. 2, the billiard balls 40 are positioned in the interior area 14 of the frame 12, with the engaging section in the release position. The frame 12 can be sized to receive sixteen billiard balls 40, with eight balls being positioned in each of the two interior sections 14*a*, 14*b* of the of the frame 12. As shown in FIG. 4, each interior section 14*a*, 14*b* has an inner column 40*a* and an outer column 40*b* of four balls 40 each that are arranged linearly and substantially parallel to the outer panels 22, 24 of the engaging section 20.

Figure 6:
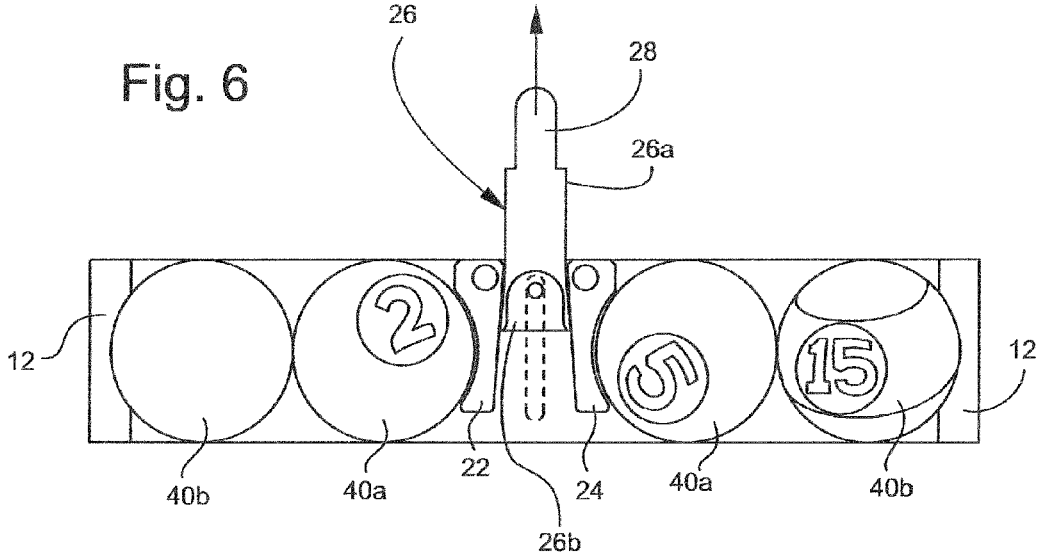
Figure 8:
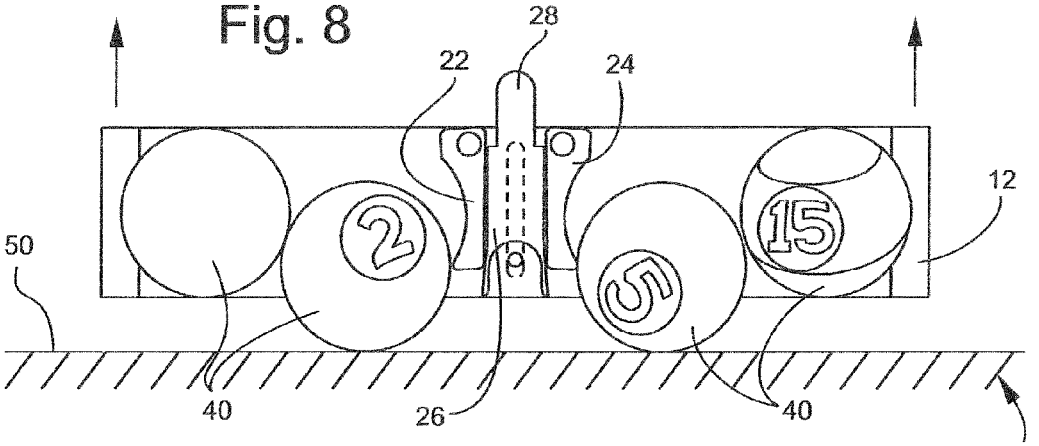
Figure 9:
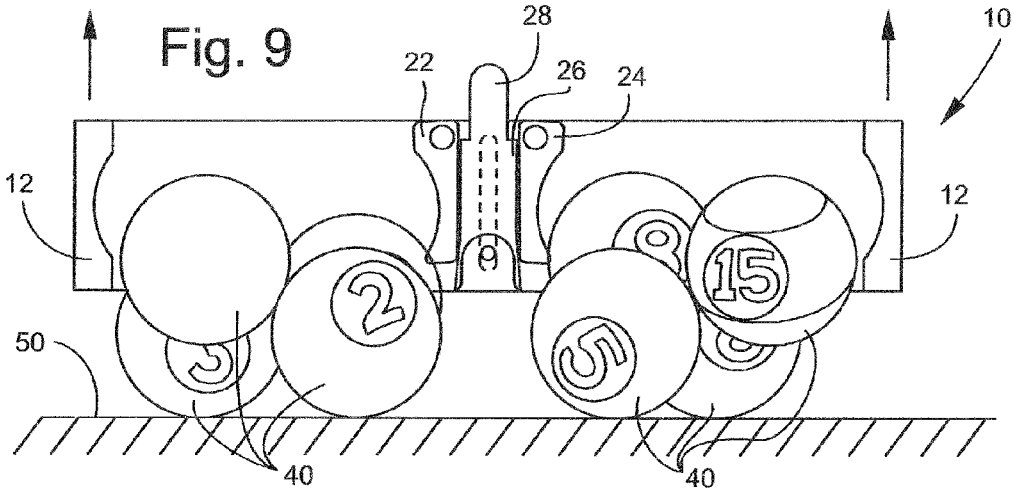

As shown in FIGS. 1 and 9, the inner surface of the frame 12 can be concave to conform to the contour of the billiard balls. Likewise, the outer surface of each of the outer panels 22, 24 can be concave to conform to the shape of the billiard balls 40, as shown in FIGS. 1, 6 and 8. The concave inner surface of the frame 12 and the concave outer surface of the outer panels 22, 24 provide mechanical support to the balls 40, and prevent them from falling when the carrier 10 is lifted up. In addition, two concave sections 30, 32, shown in FIG. 1, can be formed at the top edge of the outer surface of each outer panel 22, 24 to further conform with the contour of two balls 40*a* of the inner columns, shown in FIG. 4.

Figure 3:
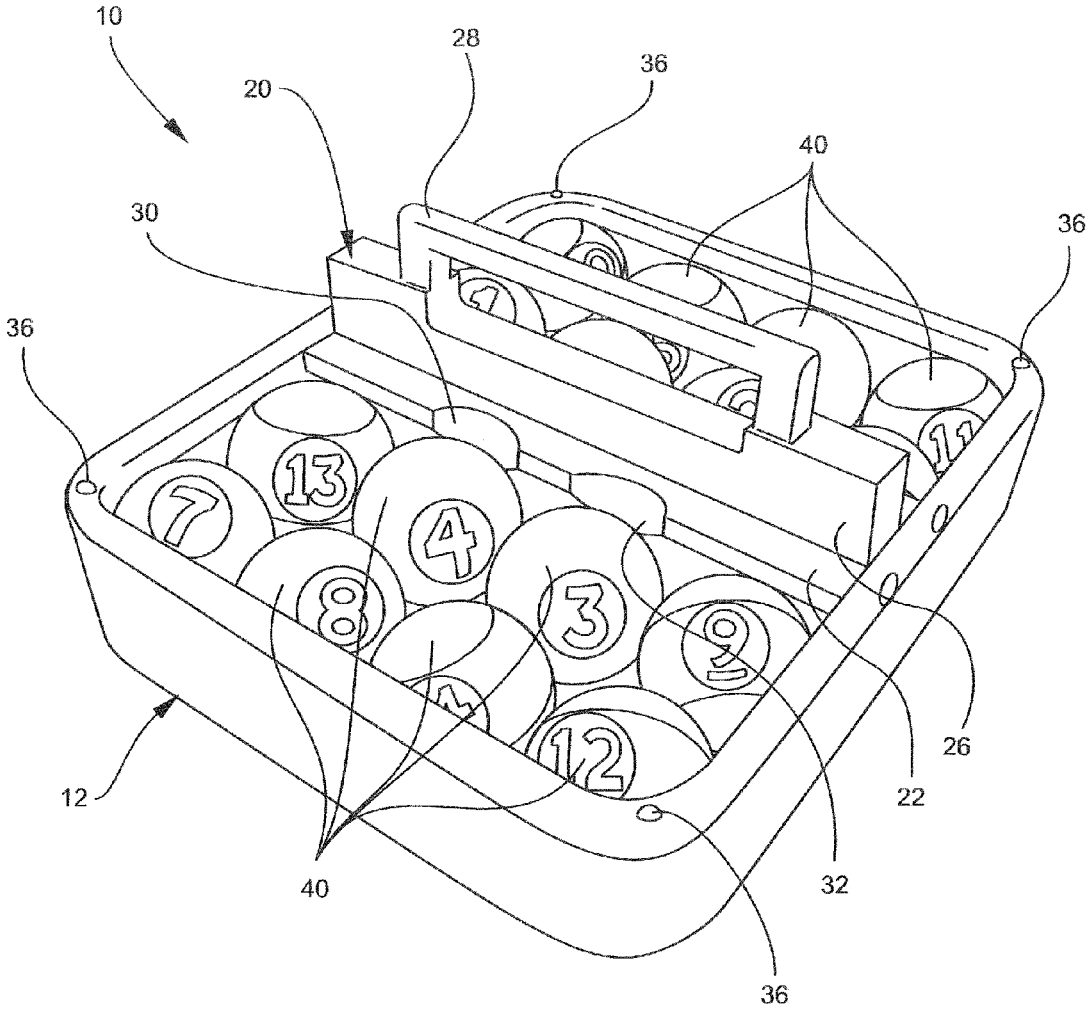
FIG. 3 is another perspective view of the ball carrier of FIG. 1, shown in use with billiard balls.

When the engaging section 20 is in the release position, shown in FIG. 2, the billiard balls 40 can be easily placed within the frame 12. Once all of the sixteen balls 40 are positioned within the frame 12, the user lifts up on the handle 28, and the base 26*b* of the center panel 26 is moved up against the inner surface of the outer panels 22, 24, thereby urging the outer panels 22, 24 outward against the inner columns of balls 40*a*, as shown in FIG. 6. This in turn forces the inner columns of balls 40*a* against the outer columns of balls 40*b*, resulting in all balls 40*a*, 40*b* being held in tight frictional engagement within the frame 12, as the handle 28 reaches its upper most position, shown in FIG. 3.

Figure 7:
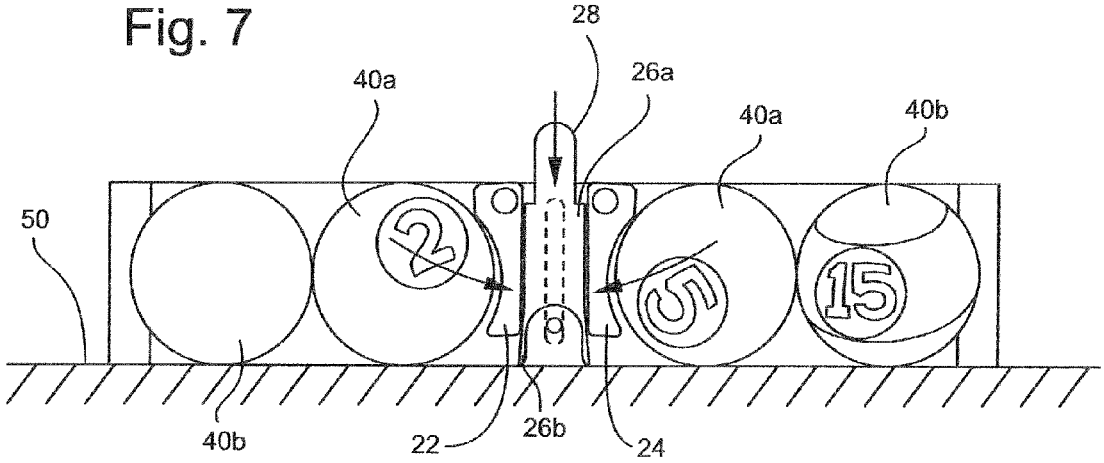
Figure 10:
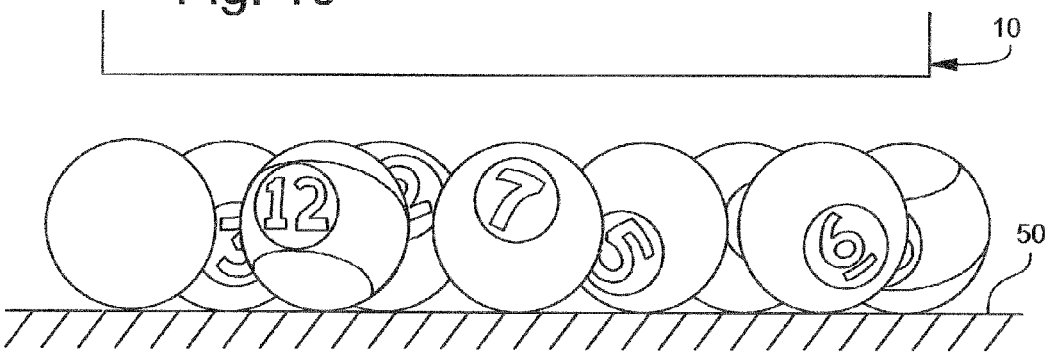

In this engage position, the user can then grasp the carrier 10 by the handle 28, and move the carrier 10, with the balls 40 held tightly therein, to a desired location, such as a billiard table where the balls 40 will be used in a game. Upon arriving at the table, the carrier 10 is placed on the top surface 50 of the table, and the user pushes down on the upwardly extended handle 28, forcing the center panel 26 downward into the release position, in which the tight frictional engagement of the balls 40 is released, as shown in FIG. 7. The user can then lift up the carrier 10 by the frame, and all of the balls 40 drop freely onto the top surface 50 of the table, as shown in FIGS. 8 and 9. The carrier 10 is removed away from the table, as shown in FIG. 10, and the balls 40 can be used in a billiard game. When the game is over, the balls 40 can be reloaded into the carrier 10 in the release position, and the process of moving the engaging section from the release position to the engage position described above can be repeated. The carrier 10 can then be used to transport the balls 40 to a shelf or similar destination for storage in the carrier 10 until the balls 40 are to be used again.

Figure 11:
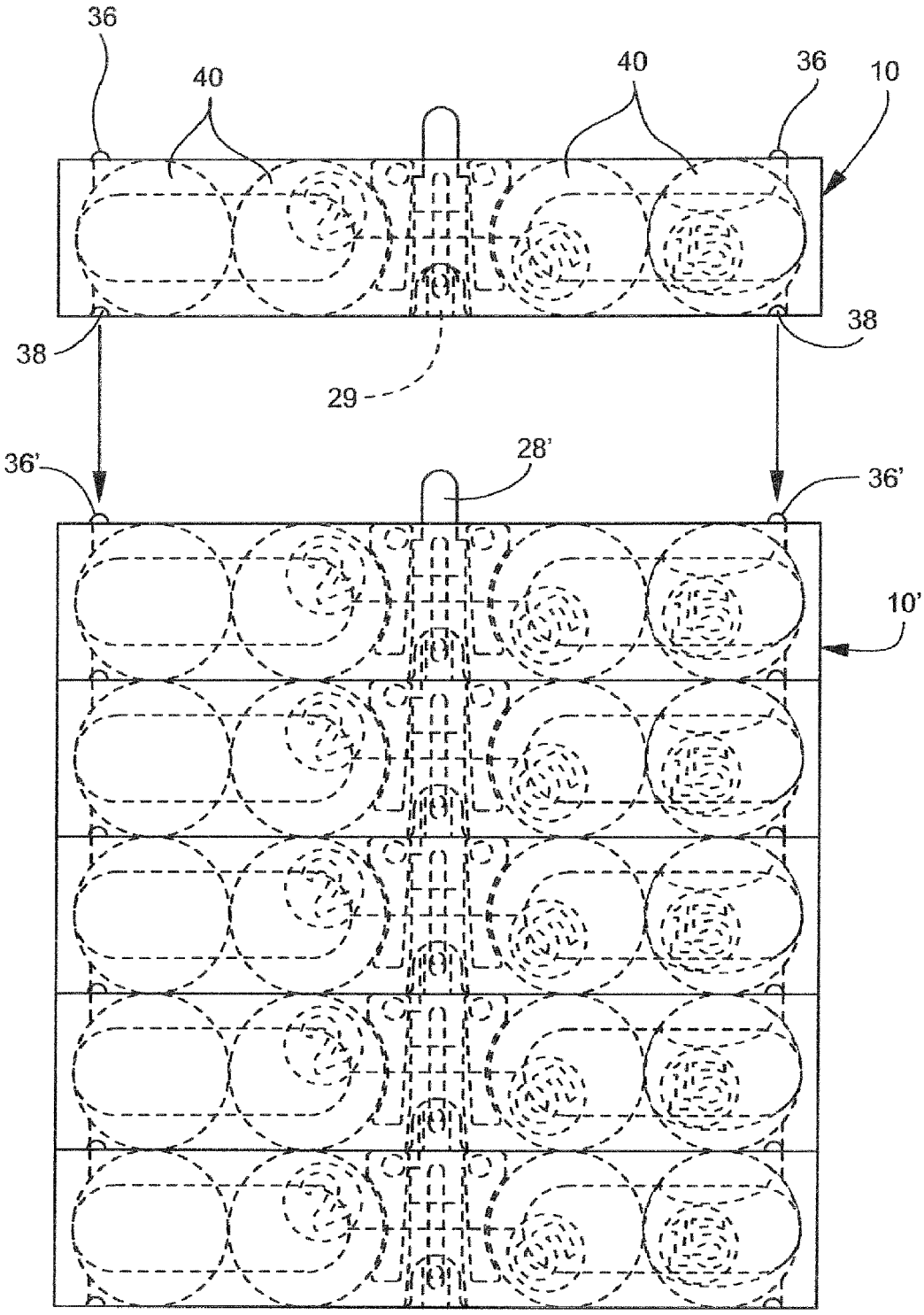
FIG. 11 is a front elevation of a plurality of stacked ball carriers, according to a preferred embodiment of the invention, with balls shown in phantom.
Figure 12:
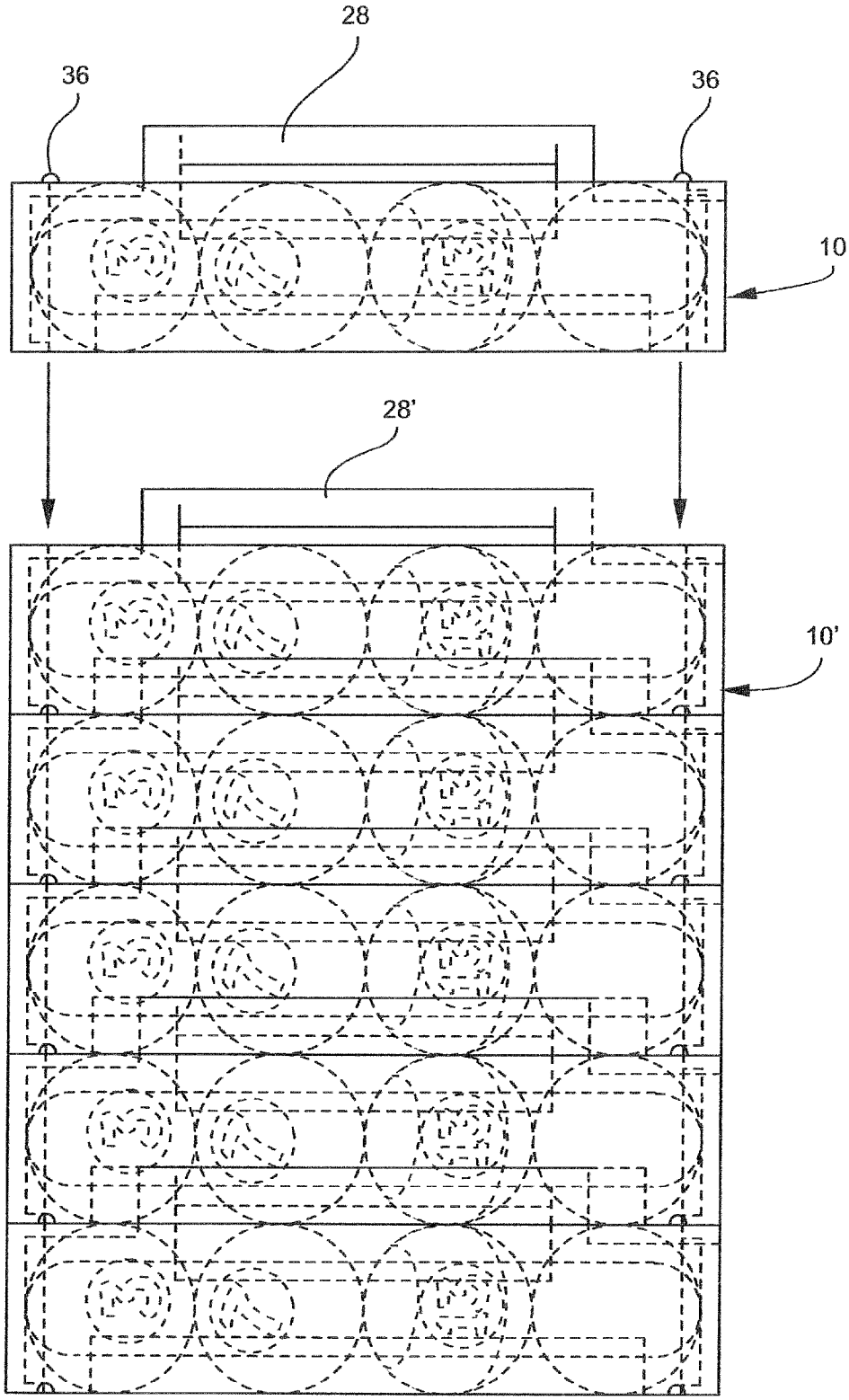
FIG. 12 is a side elevation of the stacked ball carriers of FIG. 10.

As shown in FIG. 1, the carrier 10 can include four knobs 36 extending upwardly from the top surface of the frame 12. Preferably, one knob 36 is positioned proximate each of the four corners of the frame 12. A corresponding recess 38 is formed at the bottom surface of the frame in vertical alignment with each knob 36, as shown in FIG. 11. As such, a plurality of carriers can be stacked upon each other, as shown in FIGS. 11 and 12. As shown in FIG. 11, the recesses 38 of one carrier 10 receive the knobs 36' of another carrier 10' positioned below as the first carrier 10 is stacked upon the second carrier 10'. In addition, a recess 29 is formed at the base 26*b* of the center panel 26 of the first carrier 10 to receive the upwardly extending handle 28' of the second carrier 10'. This complementary arrangement helps to stabilize a plurality of stacked carriers being used to store the billiard balls 40. Alternatively, the recesses can be formed in the top surface of the carrier frame, and the outwardly extending knobs formed on the bottom surface.

A ball carrier and a method of using same are described above. Various details of the invention may be changed without departing from its scope. For example, while a preferred embodiment of the invention is described above as being adapted for use with billiard balls, the invention is not so limited and can be used with other spherical objects, such as tennis balls, baseballs and golf balls. The foregoing description of the various embodiments of the invention and the best mode for practicing the invention are provided for the purpose of illustration only and not for the purpose of limitation the invention being defined by the following claims and equivalents thereof.

What is claimed is:

1. An apparatus for carrying a plurality of spherical objects comprising:

(a) a rectangular frame defining an interior area for receiving the plurality of spherical objects, wherein at least some of the plurality of spherical objects contact an inner surface of the frame, and further wherein the inner surface of the frame is concave to conform to the contour of the spherical objects and provides support to the spherical objects contacting the inner surface of the frame;

(b) an engaging element connected to the frame and positioned within the interior area of the frame; and (c) adjusting means for moving the engaging element between a release position wherein the spherical objects can be placed into and removed from the frame, and an engage position wherein the engaging element frictionally engages at least some of the plurality of spherical objects and the plurality of spherical objects are maintained within the frame by frictional engagement with the engaging element and the inner surface of the frame, whereby the plurality of spherical objects are carried by the apparatus and can be transported therein.

2. An apparatus according to claim 1, wherein the engaging element comprises first and second elongate walls defining a space therebetween, and the adjusting means comprises a center panel positioned in the space defined by the first and second elongate walls and adapted for sliding movement therein, the center panel having an upper edge and a base edge, and having a graduated thickness wherein the base edge of the panel is relatively thicker than the upper edge whereby upward movement of the center panel urges the first and second walls outward to frictionally engage at least some of the plurality of spherical objects.

3. An apparatus according to claim 2, wherein downward movement of the center panel allows the first and second walls to retract inward thereby disengaging the first and second walls from the spherical objects.

4. An apparatus according to claim 3, wherein the center panel includes an opening proximate the upper edge to provide a handle for grasping.

5. An apparatus according to claim 4, wherein the adjusting means can be moved from the release position to the engage position by grasping the handle and pulling upward.

6. An apparatus according to claim 2, wherein the first and second walls extend between opposed sides of the frame, and the plurality of spherical objects comprises sixteen billiard balls.

7. An apparatus according to claim 1, further comprising a handle for facilitating carrying of the apparatus.

8. An apparatus according to claim 1, wherein the frame includes a top surface and a bottom surface, and further comprising a plurality of upwardly extending knobs formed on the top surface, and a plurality of recesses formed on the bottom surface in substantial vertical alignment with the upwardly extending knobs.

9. An apparatus according to claim 1, wherein the frame includes a top surface and a bottom surface, and further comprising a plurality of downwardly extending knobs formed on the bottom surface, and a plurality of recesses formed on the top surface in substantial vertical alignment with the downwardly extending knobs.

10. An apparatus according to claim 1, wherein the engaging element is connected proximate mid points of two opposed sides of the frame, and defines the interior area of the frame into first and second interior sections having substantially equal areas, the first interior section for receiving a first inner column of at least two spherical objects and a first outer column of at least two spherical objects, and the second interior section for receiving a second inner column of at least two spherical objects, and a second outer column of at least two spherical objects, the columns positioned substantially parallel in relation to the engaging section, and further wherein when in the engage position, the engaging element urges the first inner column of spherical objects against the first outer column of spherical objects, and the second inner column of spherical objects against the second outer column of spherical objects, whereby the first and second outer columns of spherical objects are urged against the inner surface of the frame.

11. An apparatus for carrying a plurality of billiard balls comprising:

(a) a rectangular frame defining an interior area for receiving the plurality of billiard balls, wherein at least some of the plurality of billiard balls contact an inner surface of the frame, and further wherein the inner surface of the frame is concave to conform to the contour of the balls and provides support to the balls contacting the inner surface of the frame;

(b) an engaging section connected to the frame and positioned within the interior area of the frame between two opposed sides of the frame, and wherein the engaging section comprises:

(i) first and second outer panels defining a space therebetween, wherein at least one concave section is formed on each of the first and second outer panels to conform to the contour of the balls; and (ii) a center panel positioned in the space between the first and second panels and adapted for sliding movement therein, the center panel having an upper edge and a base edge, and having a graduated thickness wherein the base edge of the center panel is relatively thicker than the upper edge whereby upward movement of the center panel urges the first and second outer panels outward to frictionally engage at least some of the plurality of billiard balls; and (c) wherein the engaging section is adapted for moving between a release position wherein the billiard balls can be placed into and removed from the frame, and an engage position wherein the inner surface of the frame and the first and second outer panels of the engaging section frictionally engage the plurality of billiard balls whereby the plurality of balls are carried by the apparatus and can be transported therein.

12. An apparatus according to claim 11, wherein two concave sections are formed on each of the first and second outer panels to conform to the contour of the plurality of billiard balls.

13. An apparatus according to claim 11, wherein downward movement of the center panel allows the first and second outer panels to retract inward whereby the first and second outer panels are disengaged from the plurality of billiard balls.

14. An apparatus according to claim 11, wherein the center panel includes an opening proximate the upper edge to provide a handle for grasping, and further wherein the engaging section is moved from the release position to the engage position by grasping the handle and pulling upward.

15. An apparatus according to claim 11, wherein the frame is substantially square and sized to carry sixteen billiard balls.

16. An apparatus according to claim 15, wherein the engaging section is connected proximate mid points of two opposed sides of the frame, and defines the interior area of the frame into first and second interior sections having substantially equal areas, further wherein the first interior section receives a first inner column of four billiard balls and a first outer column of four billiard balls, and the second interior section receives a second inner column of four billiard balls and a second outer column of four billiard balls, the columns positioned substantially parallel in relation to the engaging section.

17. An apparatus according to claim 16, wherein when in the engage position, the first outer panel contacts the first inner column of billiard balls and the second outer panels contacts the second inner column of billiard balls, the first outer panel urging the first inner column of billiard balls against the first outer column of billiard balls, and the second outer panel urging the second inner column of billiard balls against the second outer column of billiard balls, whereby the first and second outer columns of billiard balls are urged against the inner surface of the frame, and all of the balls are maintained by frictional engagement in the frame.

18. An apparatus according to claim 11, wherein the frame includes a top surface and a bottom surface, and further comprising a plurality of upwardly extending knobs formed on the top surface, and a plurality of recesses formed on the bottom surface in substantial vertical alignment with the upwardly extending knobs.

19. A method of carrying billiard balls comprising the steps of:

(a) providing a plurality of billiard balls;

(b) providing a carrying apparatus comprising:

(i) a rectangular frame defining an interior area for receiving the plurality of billiard balls, wherein at least some of the plurality of billiard balls contact an inner surface of the frame, and further wherein the inner surface of the frame is concave to conform to the contour of the balls and provides support to the balls contacting the inner surface of the frame;

(ii) an engaging section connected to the frame and positioned within the interior area of the frame between two opposed sides of the frame, and comprising first and second outer panels defining a space therebetween, wherein at least one concave section is formed on each of the first and second outer panels to conform to the contour of the balls, and a center panel positioned in the space between the first and second panel and adapted for sliding movement therein, the center panel having an upper edge and a base edge, and having a graduated thickness wherein the base edge of the center panel is relatively thicker than the upper edge whereby upward movement of the center panel urges the first and second outer panels outward to frictionally engage at least some of the plurality of billiard balls, and (iii) wherein the engaging section is adapted for moving between a release position wherein the billiard balls can be placed into and removed from the frame, and an engage position wherein the engaging section frictionally engages at least some of the plurality of billiard balls and the plurality of balls are maintained within the frame;

(c) positioning the balls in the interior area of the frame with the engaging section in the release position; and (d) moving the engaging section to the engage position whereby at least some of the plurality of billiard balls are engaged by the engaging section and maintained within the carrying apparatus.

20. A method according to claim 19, further comprising the steps of:

(a) transporting the carrying apparatus with the plurality of billiard balls maintained therein while the engaging section is in the engage position;

(b) positioning the carrying apparatus on a desired surface; and (c) moving the engaging section to the release position whereby the plurality of billiard balls are disengaged from the engaging section and are released onto the desired surface.

* * * * *